United States Patent [19]

Neyret

[11] Patent Number: 4,550,580

[45] Date of Patent: Nov. 5, 1985

[54] ROTATABLE CONNECTION DEVICE

[75] Inventor: Guy Neyret, Oullins, France

[73] Assignee: Neiman S.A., Courbevoie, France

[21] Appl. No.: 579,891

[22] PCT Filed: May 16, 1983

[86] PCT No.: PCT/EP83/00123

§ 371 Date: Jan. 11, 1984

§ 102(e) Date: Jan. 11, 1984

[87] PCT Pub. No.: WO83/04067

PCT Pub. Date: Nov. 24, 1983

[30] Foreign Application Priority Data

May 19, 1982 [FR] France ..... 82 08755

[51] Int. Cl.[4] ..... E05B 9/08

[52] U.S. Cl. ..... 70/370; 70/379 R; 70/451

[58] Field of Search ..... 70/370, 379 R, 380, 70/451; 248/27; 16/110 R, 114 R, 121

[56] References Cited

U.S. PATENT DOCUMENTS 1,550,379 8/1925 Manteufel ..... 70/380

4,363,230 12/1982 Lipschutz ..... 70/451

FOREIGN PATENT DOCUMENTS 806882 5/1974 Belgium .

995045 4/1951 France ..... 70/370

1340821 9/1963 France ..... 70/379 R

*Primary Examiner*—Robert L. Wolfe

*Attorney, Agent, or Firm*—Karl F. Ross; Herbert Dubno

[57] ABSTRACT

The invention relates to a rotatable connection device for a driving part (1) to a driven part (2), wherein the driven part has a rotational play relative to the driving part. The driving part (1) exhibits at least two axial elastic dogs (3, 4) which end in radial teeth (5, 6) and cooperate with circular arcuate slots (8, 9) in the driven part (2), which exhibit enlarged regions (11, 13) for the passage of the radial teeth (5, 6), and with a securing part (14). This securing part (14) is provided with holes (15, 16) to receive the elastic dogs (3, 4), and a bendable strap (17, 18), which is present at each hole (15, 16), after being bent behind the dogs (3, 4), comes into abutment opposite the teeth (5, 6) at their ends. Any accidental disassembly is prevented by this means.

2 Claims, 2 Drawing Figures

ROTATABLE CONNECTION DEVICE

The invention relates to a rotatable connection device for a driving part to a driven part, wherein the driven part has a rotational play relative to the driving part.

As an example of the application of such a device, although it is not restricted thereto, the entrainment of a locking and unlocking cam by a lock cylinder, particularly on motor vehicle doors, may be mentioned.

In known devices, retaining rings are used for this purpose, but they are difficult to assemble and they fail to ensure adequate guidance of the parts.

The invention proposes to obviate these disadvantages of known devices.

This aim is achieved according to the invention in that the driving part exhibits at least two axial elastic dogs, which each end in a radial tooth and each cooperate with a circular arcuate slot in the driven part, which exhibits an enlarged region for the passage of the radial tooth of the corresponding dog, and with a securing part which is provided with holes to receive the ends of the elastic dogs, and the holes of which each exhibit a bendable strap which, after being bent behind the relevant dog, comes into abutment opposite the tooth at the end of said dog.

Figure 1:
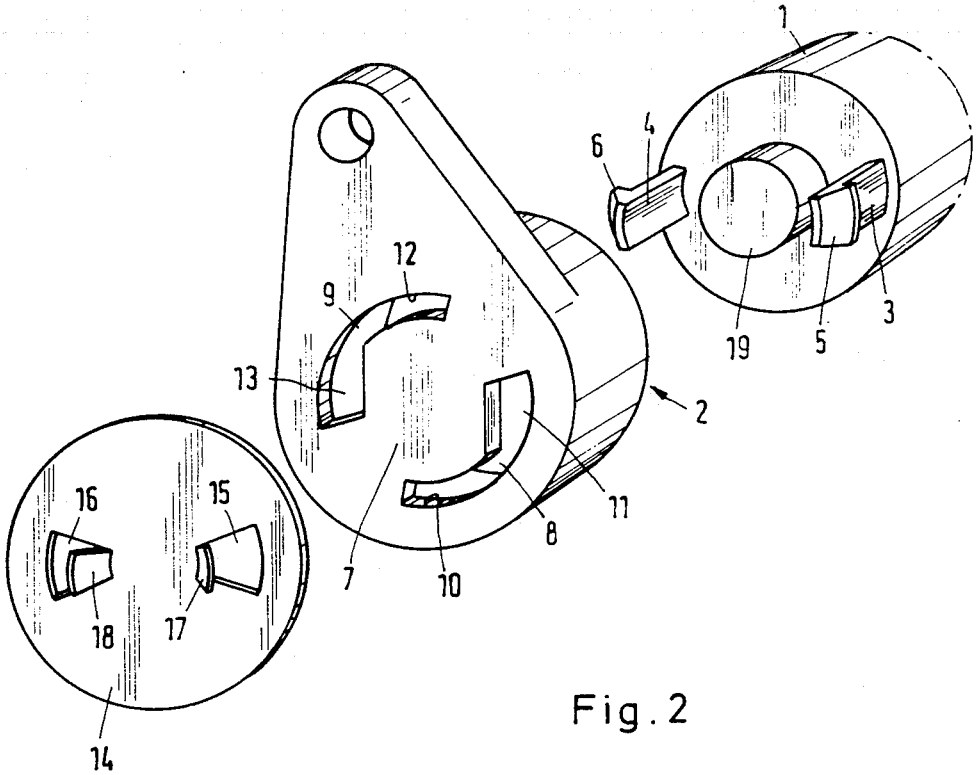
Figure 2:
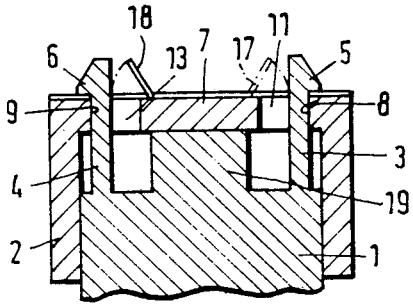

The invention is explained more fully with reference to the drawings, wherein:

FIG. 1 shows an exploded perspective view of the end of a lock cylinder equipped with a device according to the invention and FIG. 2 shows an axial sectional view of the device illustrated in FIG. 1, in the final phase of its assembly.

The device according to the invention is intended for the rotatable connection of a driving part 1, which consists of a lock cylinder in the example described, to a driven part 2, which consists of a locking and unlocking cam in this example. A rotational play is provided between the two parts 1 and 2.

The cylinder exhibits two axial, axially parallel, elastic dogs 3 and 4 located mutually diametrically opposite at equal intervals from the cylinder axis, which are each provided with a radial tooth 5, 6 which is directed outwards away from the cylinder 1. That part of the cylinder 1 which carries the dogs 3, 4 may consist of plastics, so that the dog attachments are elastically deformable due to their shape.

The body of the cam 2 has the shape of a hollow cylinder and is closed on the side opposite the cylinder

1 by an end 7 which exhibits two slots 8, 9 of circular arcuate shape. The slot 8 intended to receive the dog 3 exhibits a region 10, the width of which is somewhat greater than the thickness of the dog 3, but smaller than the total width of the tooth 5, and which merges into an increasingly enlarged region 11, of which at least one part is wider than the tooth 5. The slot 9 exhibits a narrow region 12 and an enlarged region 13 analogously to the relevant regions 10 and 11 of the slot 8.

The device further consists of a securing part 14, which is formed by a circular disc in which two holes 15, 16 are punched, at each of which a bendable strap 17, 18 is present.

The cylinder 1 also ends in an axial attachment 19 which comes into abutment against the end 7 of the cam body 2 during assembly. The ends of the dogs 3, 4 are guided through the widened regions 11, 13 of the slots 8, 9, and the teeth 5, 6 are guided, with elastic deformation of the dogs 4, 3, inwards through these regions and the holes 15,16 in the securing parts 14.

As soon as the hooks protrude on the external surface (FIG. 2), the dogs 3, 4 return to their initial position, and the teeth 5, 6 are applied against the external surface of the securing part 14. The straps 17, 18 are now bent into the horizontal (in FIG. 2) so that the dogs 3, 4 can no longer bend inwards. Any accidental disassembly is prevented by this means. The rotatability of the cam 2 relative to the cylinder 1 depends upon the overall length of the slots 8, 9.

I claim:

1. Rotatable connection device for a driving part to a driven part, wherein the driven part has a rotational play relative to the driving part, characterised in that the driving part (1) exhibits at least two axial elastic dogs (3,4) which each end in a radial tooth (5,6) and each cooperate with a circular arcuate slot (8,9) in the driven part (2), which exhibits an enlarged region (11, 13) for the passage of the radial tooth (5,6) of the corresponding dog (3,4), and with a securing part (14) which is provided with holes (15, 16) to receive the ends of the elastic dogs (3,4), and the holes (15, 16) of which each exhibit a bendable strap (17, 18) which, after being bent behind the relevant dog (3,4), come into abutment opposite the tooth (5,6) at the end of said dog.

2. Device according to claim 1, characterised in that the dogs (3,4) and at least a part of the driving part (1) consist of plastics and of one piece.

* * * * *